United States Patent [19]

Hodges

[11] 4,405,176

[45] Sep. 20, 1983

[54] METHOD FOR HYDRAULICALLY MINING UNCONSOLIDATED SUBTERRANEAN MINERAL FORMATIONS USING REMOTE SUPPORT

[76] Inventor: Everett L. Hodges, 49 Royal St. George, Newport Beach, Calif. 92660

[21] Appl. No.: 243,819

[22] Filed: Mar. 16, 1981

[51] Int. Cl.[3] ..... E21C 45/00

[52] U.S. Cl. ..... 299/17; 175/67

[58] Field of Search ..... 299/17, 4, 5; 175/61, 175/67; 166/96, 245

[56] References Cited

U.S. PATENT DOCUMENTS

| | | | |
|---|---|---|---|
| 989,441 | 4/1911 | Suits et al. | 166/96 |
| 2,444,629 | 7/1948 | Bromberg | 299/17 |
| 3,030,086 | 4/1962 | Donaldson et al. | 299/17 X |
| 3,695,351 | 10/1972 | Lubinski | 166/96 |

OTHER PUBLICATIONS

Davis et al., "Controlled Uranium Solution Mining Operations", Mining Congress Journal, Oct. 1978, pp. 35–38.

*Primary Examiner*—Ernest R. Purser

*Attorney, Agent, or Firm*—Hubbard & Stetina

[57] ABSTRACT

An improved apparatus and method for hydraulically mining unconsolidated subterranean mineral formations is disclosed wherein the hydraulic mining tool and surface drilling equipment is supported upon elongate structural beams releasably affixed at opposite ends to laterally spaced concrete foundations positioned upon the drilling site. The structural beams prevent the mining tool from canting or subsiding during the hydraulic mining process and may be reused for consecutive mining operations at differing locations upon the drilling site. An improved mining tool configuration is additionally disclosed which is specifically adapted to agitate and maintain the mined minerals in suspension within the mining slurry and further direct the slurry toward the mining tool for subsequent transport to ground surface. To increase the mining/recovering rate, the present invention further disclose the use of plural cutting jet conduits which are positioned radially outward from the hydraulic mining tool and submerged within the mineral formation. During the mining operation, a high velocity cutting stream is simultaneously applied through each of conduits and directly radially inward through the formation to transport mined mineral particles toward the mining tool.

5 Claims, 19 Drawing Figures

Fig. 1 (PRIOR ART)
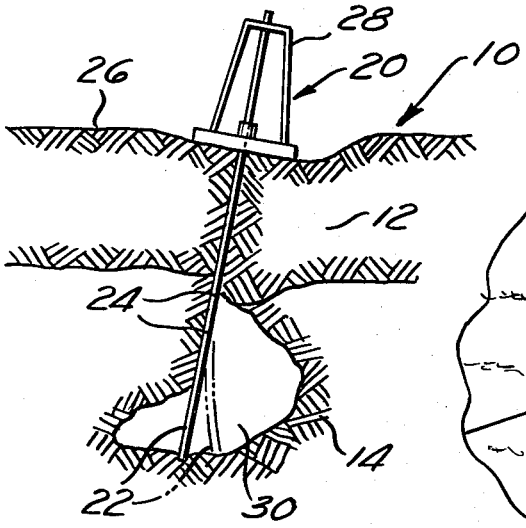
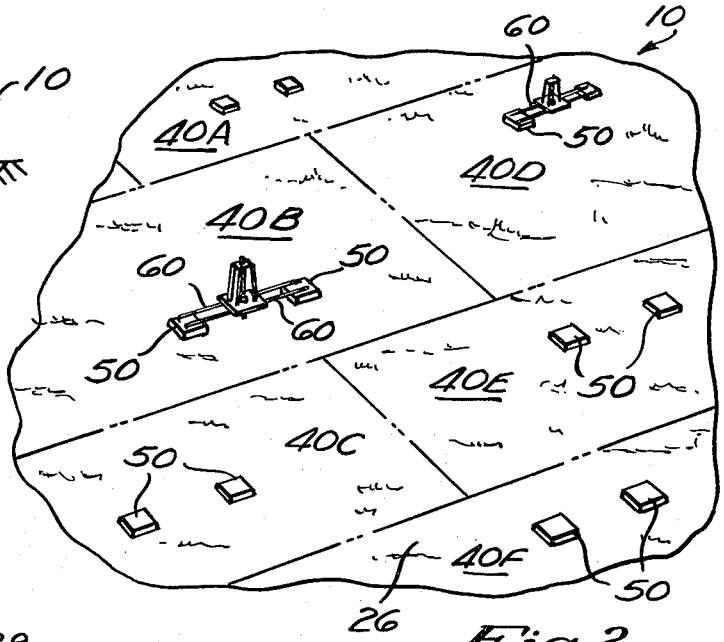
Fig. 2
Fig. 3
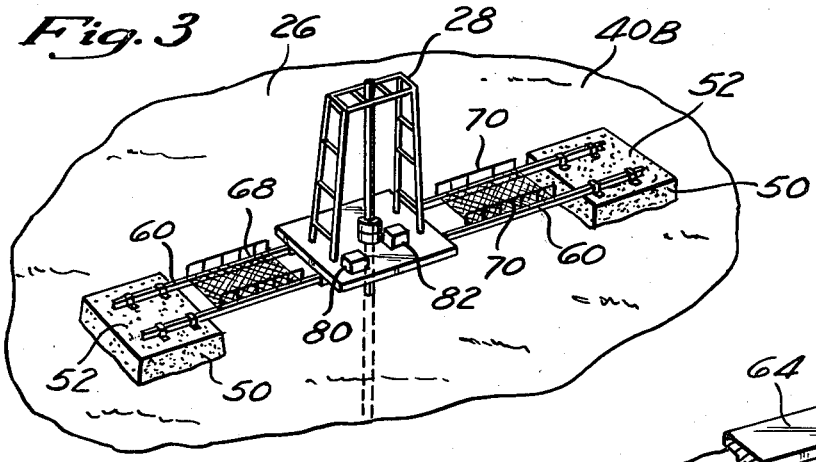
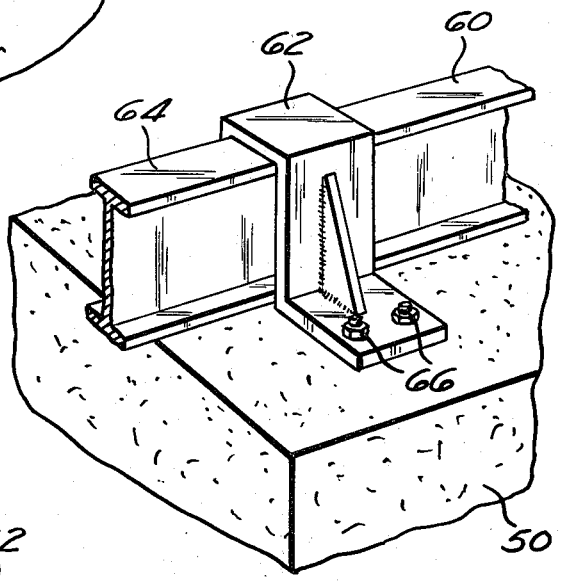
Fig. 5
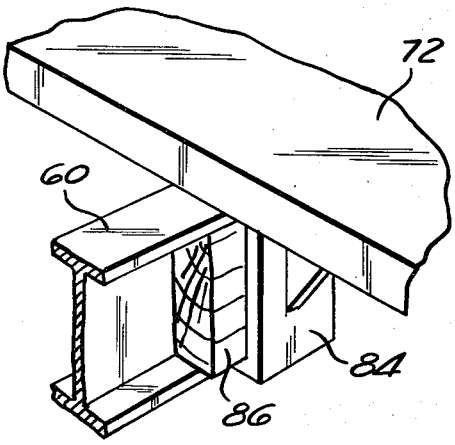
Fig. 4
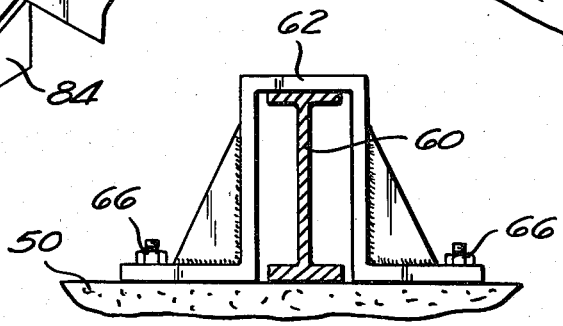
Fig. 6

Fig. 9
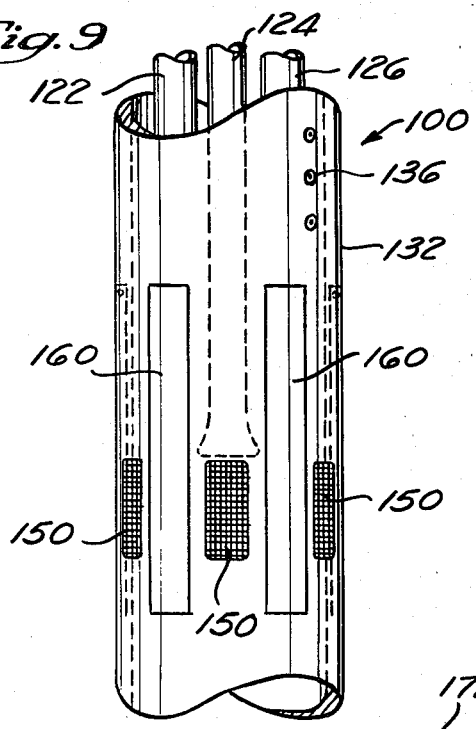
Fig. 10
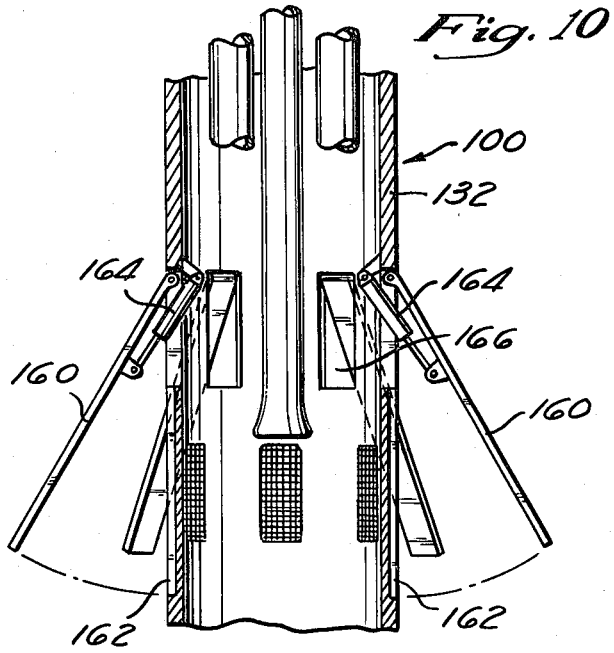
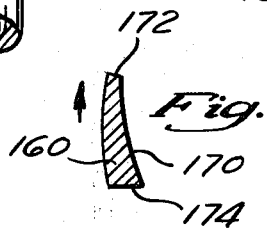
Fig. 13
Fig. 11
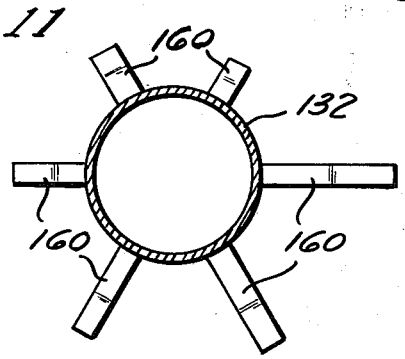
Fig. 15
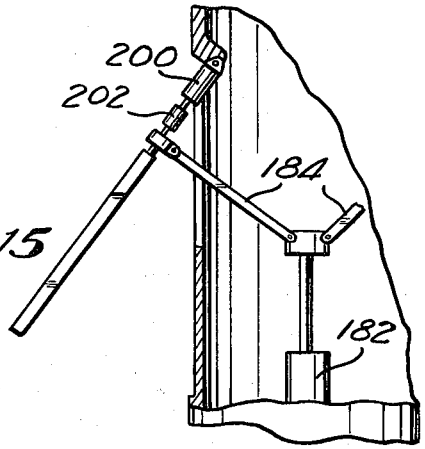
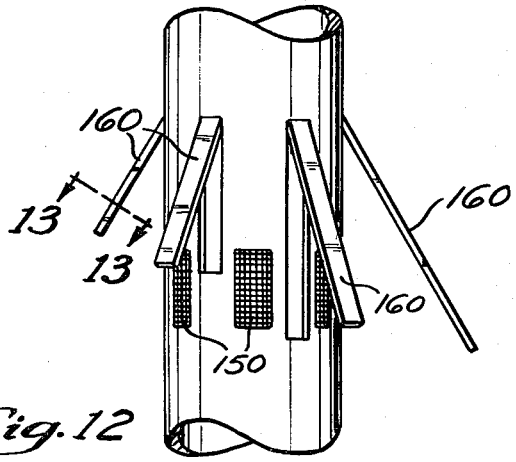
Fig. 12
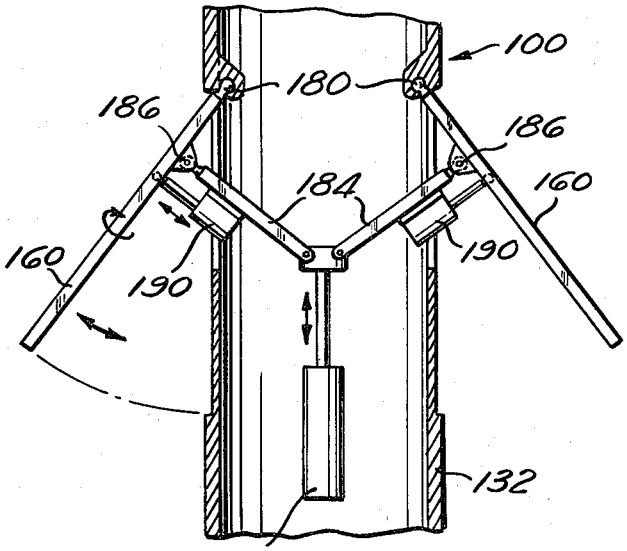
Fig. 14

Fig. 16
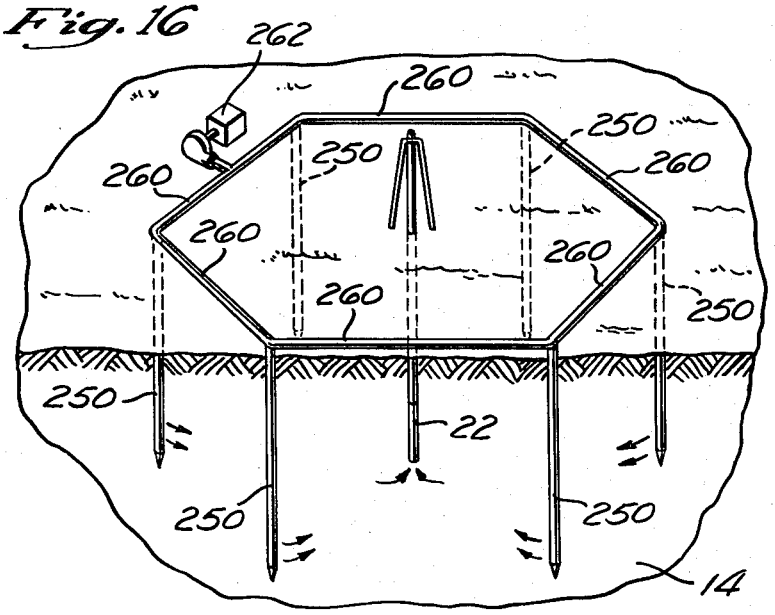
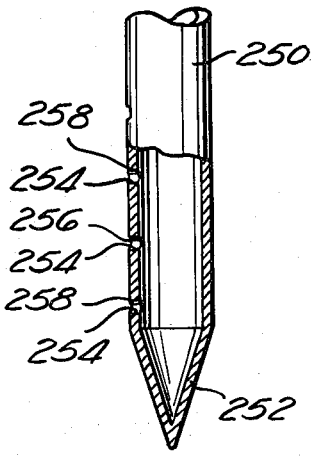
Fig. 18
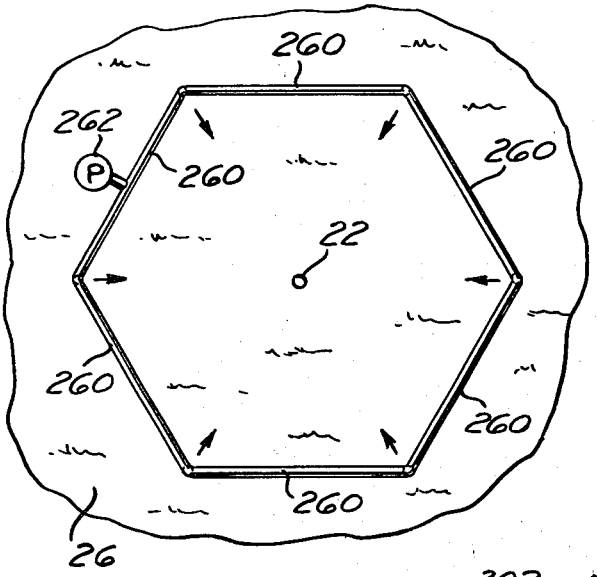
Fig. 17
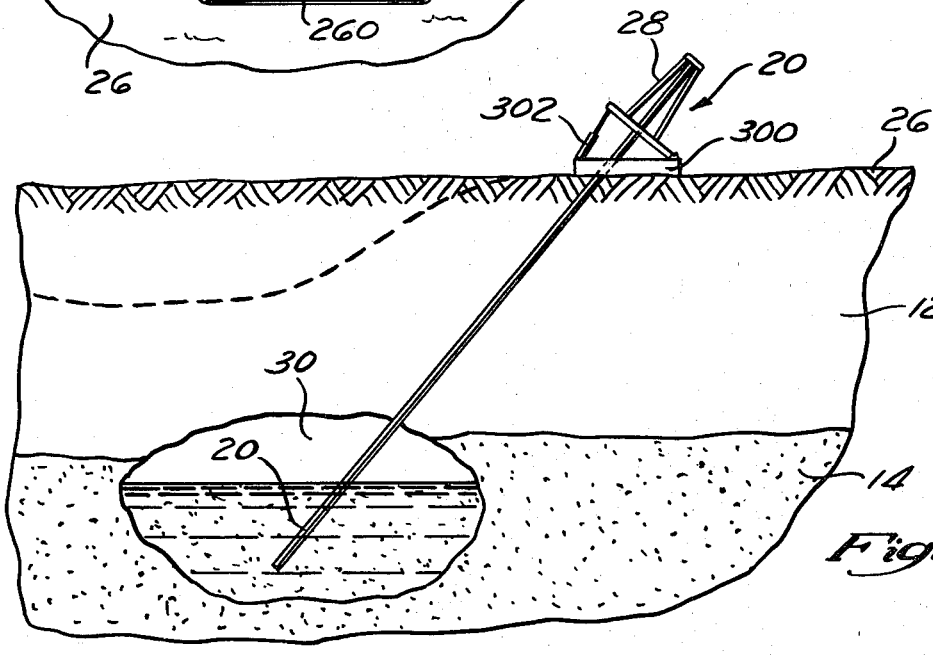
Fig. 19

METHOD FOR HYDRAULICALLY MINING UNCONSOLIDATED SUBTERRANEAN MINERAL FORMATIONS USING REMOTE SUPPORT

BACKGROUND OF THE PRESENT INVENTION

The present invention relates generally to hydraulic mining tools utilized for the recovery of subterranean mineral deposits and more particularly to an improved hydraulic mining tool and method of hydraulically mining unconsolidated mineral formations, such as tar sands and the like.

Hydraulic mining apparatus is well-known in the art, being characterized by the use of a high velocity liquid stream being discharged directly into a subterranean mineral deposit. The liquid stream dislodges minerals from the subterranean mineral bed and forms a resultant mineral slurry which may be subsequently pumped upward through the interior of the mining tool to ground surface. Examples of various hydraulic mining tools are disclosed in the U.S. Pat. No. 3,951,457 issued to Redford, and my co-pending patent application Ser. No. 053,029, filed June 28, 1979, entitled Downhole Pump With Bottom Receptor, the disclosures of which are expressly incorporated herein by reference.

The vast majority of such hydraulic mining tool apparatus have been utlized to recover minerals such as uranium, coal and/or potash, which typically are sufficiently consolidated in their natural formation state such that as mined material is removed from the subjacent portions of the mineral bed, the mineral bed, and in particular the overburden located above the mineral bed, is continuously supported during the mining process. Thus, in the hydraulic mining of such consolidated formations, substantial quantities of the mineral bed may be removed from the formation, without experiencing any significant downward migration of the overburden into the mineral bed or an attendant ground surface subsidence. However, in the hydraulic mining of unconsolidated mineral formations such as tar sands and the like, unique over-burden support problems exist, which to a great extent has rendered the majority of existing hydraulic mining tools and their methods of operation unsuitable and commercially infeasible.

In contra-distinction to consolidated mineral formations, unconsolidated mineral formations generally are non-uniform in composition and typically possess relatively small magnitude cementation forces between individual mineral particles, whereby the unconsolidated formations fail to possess the necessary degree of stabilization to support the overburden during the hydraulic mining process. Thus, as the subjacent portions of the unconsolidated mineral bed are removed during the mining process, the overburden often compacts and migrates downward into the the mineral bed wherein it mixes with the mined mineral slurry and is subsequently transported upward to ground surface. The mining of such non-mineral bearing overburden reduces the overall efficiency of the hydraulic mining process, and if substantial, may reduce the economic effectiveness of the process below acceptable profit levels. Further, in those instances where this downward migration of the overburden becomes acute, a general subsidence of the overburden may be experienced which may result in a bending or "twist-off" of the mining tool within the mineral bed.

In addition, due to the small magnitude cementation forces existing in mineral formations, the amount of mineral particles freed from the mineral bed during the mining process often is extremely large and may exceed the saturation or suspension level of the discharged liquid within the mineral bed. When this saturation condition occurs, the freed mineral particles fail to be carried or suspended for sufficient period of time within the slurry and typically migrate downward to the lowermost portion of the hydraulic mining cavity. Since the transport to ground surface of the mined material during the hydraulic mining process is dependent upon the existance of a slurry condition, any freed mineral particles falling to the lowermost portion of the mining cavity have heretofore remained in the cavity and been unrecoverable. Thus, the efficiency of the prior art hydraulic mining processes have been significantly low in the the recovery of unconsolidated mineral formations.

Hence, there exists a substantial need in the art for an improved apparatus and method of hydraulically mining unconsolidated mineral formations which reduces the susceptibility of subsidence of the overburden during the mining process, minimizes the possibility of damage to the mining tool upon experiencing a subsidence of the overburden, and further, increases the suspension of mined material within the slurry during the mining process.

SUMMARY OF THE PRESENT INVENTION

The present invention comprises an improved hydraulic mining tool apparatus and method of hydraulically mining an unconsolidated mineral formation which specifically addresses and alleviates the above deficiencies heretofore associated in the prior art. More particularly, the present invention discloses a method of hydraulically mining an unconsolidated mineral formation wherein the surface mining equipment, as well as the mining tool and drill string, is supported upon elongated structural beams which extend laterally across ground surface. Opposite ends of the elongate structural beams are releasably affixed to concrete foundations anchored directly to ground surface at a location spaced radially outward substantially beyond the contemplated maximum diameter of the subjacent hydraulic mining cavity. As such, throughout the hydraulic mining process, the entire hydraulic mining equipment is supported from a location remote from the vicinity of the hydraulic mining cavity wherein the overburden and subjacent mineral bed remains in its natural state and possesses sufficient integrity to support the mining equipment. In addition, by this procedure, the weight of the surface mining equipment is removed from the overburden lying directly above the cavity thereby reducing the tendency of encountering a general subsidence of the overburden as well as the canting and/or bending of the mining tool during operation.

To augment the improved surface support benefits, the present invention additionally discloses the use of plural cutting jet conduits which are positioned radially outward from the hydraulic mining tool and submerged within the formation. Preferably, the plural conduits are interconnected by a manifold at ground surface whereby a high velocity liquid stream may be applied through the conduits. The lowermost end of each of the conduits includes one or more nozzle openings which are directed radially inward through the formation such that the high velocity liquid stream is discharged radially toward the mining tool. Hence, by use of the plural conduits, the mined mineral particles are continuously transported toward the mining tool to increase the mining recovery rate.

Additionally, the present invention discloses a novel means for agitating the resultant mineral slurry within the mining cavity to increase the amount of mined mineral particles suspended within the slurry and prevent downward migration of the same. In the preferred embodiment, the agitation means comprises a plurality of elongate arm members which are movably mounted to the exterior surface of the minig tool and extensible in a direction radially outward into the mining cavity. During rotation of the mining tool through the mining process, the arm members generate a swirling action within the slurry to agitate the same and aid in the suspension of the mined particles within the slurry. Thus, the heretofore propensity of the mined material to migrate downward out of the slurry condition is reduced.

Further, in an additional embodiment of the present invention, each of the arm members may be selectively rotated about their axis and extended radially outward from the tool in varying angular orientations to direct the mineral slurry toward the slurry inlets of the mining tool. Hence, by use of the arm members of the present invention, the mined mineral slurry is additionally urged or forced feed toward the interior of the tool for subsequent transport to ground surface.

In addition, by use of the apparatus and method of the present invention, an entire mineral field may be segregated into multiple drilling sites, with multiple concrete foundations being pre-poured on the ground surface. Subsequently, the elongate beams and surface mining equipment may be selectively relocated or moved between adjacent concrete foundations during consecutive mining operations such that equipment capital costs are minimized.

DESCRIPTION OF THE DRAWINGS

These as well as other features of the present invention will become more apparent upon reference to the drawings wherein;

FIG. 1 is a cross-sectional view taken through a mineral formation depicting the canting and bending of the hydraulic mining tool heretofore encountered by use of prior art methods for hydraulically mining unconsolidated mineral formations;

FIG. 2 is a perspective view of the ground surface of a mineral formation site depicting the apparatus and method of the present invention for hydraulically mining an unconsolidated mineral deposit;

FIG. 3 is a perspective view of the improved method and apparatus of the present invention illustrating the elongate beams and platform structure utilized to support the mining tool and surface mining equipment during the mining operation;

FIG. 4 is an enlarged perspective view of a portion of the drilling platform of FIG. 3 depicting the manner in which the platform is affixed to the elongate beams;

FIG. 5 is a perspective view of a portion of one of the concrete foundations of FIG. 3 depicting the manner in which the ends of the elongate beams are releasably affixed thereto; FIG. 6 is a cross-sectional view taken about lines 6—6 of FIG. 5;

FIG. 9 is a partial perspective view of a portion of the hydraulic mining tool of FIG. 8 depicting the plural arm members disposed on the exterior surface of the tool utilized for agitating the mined slurry within the mining cavity;

FIG. 10 is a cross-sectional view of FIG. 9 depicting the mechanism for extending the plural arm members;

FIG. 11 is a plan view depicting the plural arm members of the present invention extended in varying angular orientations from the mining tool;

FIG. 12 is an additional embodiment of the plural arm members of the present invention wherein each of the arm members is formed having different axial lengths;

FIG. 13 is a cross-sectional view taken about lines 13—13 of FIG. 12;

FIG. 14 is a cross-sectional view of the mining tool of the present invention illustrating an additional embodiment of the arm members of the present invention which may be canted about their axis during operation.

FIG. 15 is a cross sectional view of the mining tool of the present invention depicting an additional embodiment of the arm members which may be rotated about their axis during operation;

FIG. 16 is a partial cross-sectional view depicting plural cutting jet conduits which may be positioned within the mineral formation to supplement the hydraulic mining process and direct the mined material inwardly toward the hydraulic mining tool;

FIG. 17 is a plan view of the plural cutting jet conduits of FIG. 16 illustrating their special relationship to the hydraulic mining tool;

FIG. 18 is a partial cross-sectional view of the lowermost end of one of the plural conduits of FIG. 16 depicting the nozzle like apertures formed thereon; and FIG. 19 is a elevational view of an additional embodiment of the mining tool method of the present invention adapted for mining a mineral formation located at an angularly spaced position from the mining tool surface mining equipment.

DETAILED DESCRIPTION OF THE PREFERRED EMBODIMENT

Figure 7:
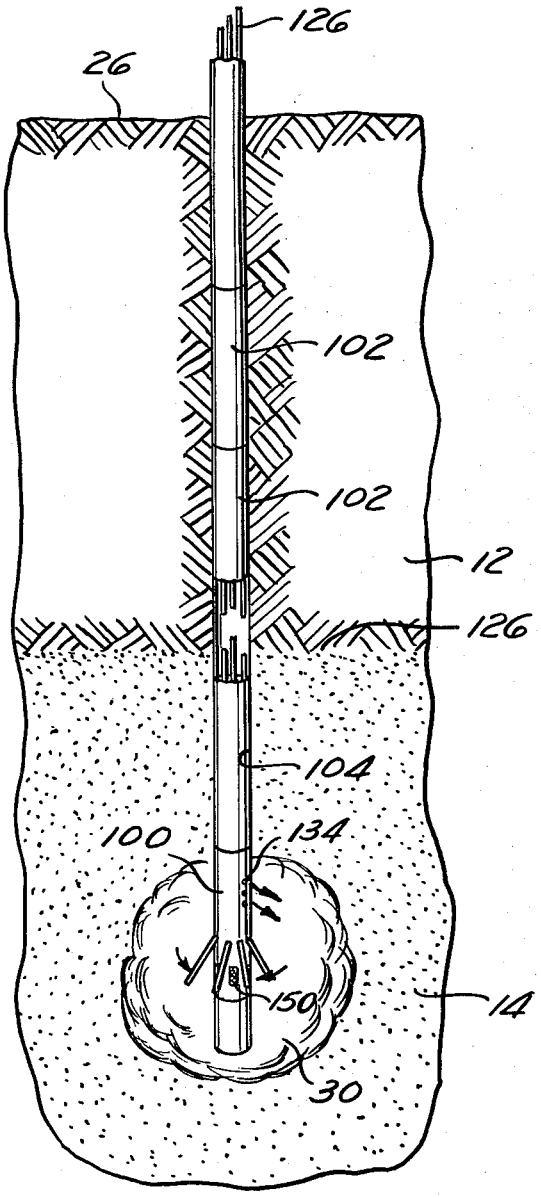
FIG. 7 is a perspective view of the hydraulic mining tool apparatus of the present invention depicted in the actual mining process, being disposed within a borehole extending from ground surface through the overburden and into the mineral bed.

Referring to FIG. 1, there is shown a mineral deposit 10 composed of an overburden 12 and an unconsolidated mineral bed 14 (such as a tar sand formation) being mined by a conventional prior art hydraulic mining tool apparatus 20. As is well-known in the art, the hydraulic mining tool apparatus 20 is composed of a mining tool 22 and a plurality of drill sections 24 which are connected in an end-to-end orientation to extend from the mineral bed 14 upward through the overburden 12 to ground surface 26. The uppermost end of the assembled drill sections 24 is supported by a suitable boom or derrick 28 positioned directly upon ground surface 26 and located vertically above the mining tool 22. Various surface support equipment (not shown) such as pumps and mechanical drives are maintained in close proximity to the derrick 28 and are utilized to rotate the mining tool 22 as well as supply a high velocity high volume liquid stream to the mining tool 22 for the mining operation.

In the prior art hydraulic mining process, a high velocity liquid stream is discharged radially outward from the mining tool 22 to impinge upon the mineral bed 14 with the dislodged minerals forming a resultant mineral slurry. As the slurry is removed from the mineral bed 14 by transporting the same upward to ground surface 26 through the mining tool 22 and drill sections 24, a mining cavity or void 30 is formed within the mineral bed. Through prolonged duration, the mining cavity 30 increases in volume, and due to the non-uniformity of the unconsolidated mineral bed 14, often propagates radially outward in an non-concentric configuration from the axis of the mining tool 22 (as depicted in FIG. 1).

In those instances where the mineral bed 14 is relatively shallow (i.e., where the overburden is only 100 to 200 feet in depth), the adjacent portions of the mineral bed 14 surrounding the mining cavity 30 typically fail to possess the necessary degree of stabilization to support the compressive weight of overburden 12 as well as the substantial weight of the hydraulic mining tool apparatus 20 and its surface support systems. As such, the portion of the overburden 12 located vertically above the mining cavity 30 may subside downward into the mining cavity 30 causing the mining tool apparatus 20 to cant as indicated in FIG. 1. During this canting, substantial compressive, tortional and sheer forces are exerted upon the mining tool 22 and drill string 24 which may cause the same to deflect or deformably bend as depicted by the phantom lines in FIG. 1, resulting in substantial damage to the mining tool 22 or in extreme instances, causing a complete twist-off wherein the mining tool 22 is irretriveably lost within the mineral bed 14.

In contrast to the prior art method and apparatus for hydraulically mining subterranean mineral formations, the present invention contemplates the support of the hydraulic mining tool apparatus at the location laterally remote to the vicinity of the mining cavity 30 whereby the weight of the apparatus is removed from the overburden located above the mining cavity 30 and the mining tool apparatus is prevented from any angular canting heretofore associated during an overburden subsidence situation. The particular method and apparatus of the present invention which yields this result may be described by a reference to FIGS. 2 through 6.

As depicted in FIG. 2, preparatory to the actual hydraulic mining process, the ground surface 26 of the entire mineral formation 10 is segregated or delineated into a plurality of surface regions or zones 40A, 40B, 40C, 40D, 40E, and 40F each of which represents a particular portion of the mineral bed 10 in which the hydraulic mining process is to be utilized. Within each of the zones 40A through 40F, a particular site best suited for the hydraulic mining operation is selected and a pair of spaced concrete foundations 50 are positioned upon the ground surface 26. The pair of foundations 50 are formed of poured concrete having dimensions of approximately $10' \times 10' \times 1'$ and positioned such that their top surfaces 52 are in a level plane. The individual foundations 50 in each pair are preferably spaced from one another at a distance approximately fifty to one hundred and fifty feet but in all cases maintained at a distance greater than the anticipated maximum diameter of the mining cavity 30 to be formed within the mineral bed 14.

A pair of elongate structural beams 60 extend in a generally parallel orientation between the pair of foundations 50 and are supported at opposite ends thereof by the top surface 52 of the foundations 50. The beams 60 are preferably formed having an I-beam cross-sectional configuration to minimize vertical deflection along their span and are sized having a web dimension of approximately 18 inches and a flange dimension of apprximately 10 inches. Each of the beams 60 are affixed to the foundations 50 by an inverted "U"-shaped bracket 62 which is sized to extend over the top surface 64 of the beams 60 and be rigidly mounted, as by way of plural anchor bolts 66 to the foundations 50. With the pair of beams 60 mounted to and spanning between the pair of foundations 50, a suitable grating 68 and railing 70 may be connected between the pair of beams 60 to provide a personnel walking platform elevated from ground surface 26.

Disposed intermediate the length of the beams 60 is a drilling platform 72 sized to support and mount the derrick 28 and the surface mining equipment such as various pumps 80 and a mechanical drive mechanism 82. As best shown in FIG. 4, the platform 72 is provided with plural mounting struts 84 located along its lower surface which slidingly receive each of the pair of beams 60. To maintain the position of the platform 72 relative to the beam 60, a pair of wedges 86 may be driven into the mounting struts 84 along opposite sides of the web portions of the beams 60 or alternatively, the mounting struts 84 may be welded directly to the beams 60. To permit the mining tool 22 and plural drill sections 24 to be inserted through the platform 72 and downward into the mineral bed 14, a central aperture (not shown) is provided through the top surface of the platform 72 and positioned so as to be located between the pair of beams 60.

By this particular structure, the entire mining tool apparatus (i.e., the derrick 28, drill sections 24, mining tool 22, and surface support equipment 80 and 82) is supported along the length of the beams 60 at an elevation raised above ground surface 26 such that the weight of the apparatus 20 is not applied to the overburden 12 in the vicinity of the subterranean mining cavity 30. Rather, the entire weight of the apparatus is concentrated at the location of the foundation pairs 50, which as previously mentioned, is laterally spaced or remote to the vicinity of the mining cavity 30. As such, during the hydraulic mining process, the additional weight of the mining tool apparatus heretofore exerted in the vicinity of the mining cavity 30 is eliminated, thereby reducing the possibility of a general subsidence of the overburden 12. Further, even in those instances when a general subsidence of the overburden is in the vicinity of the mining cavity 30 occurs, due to the entire mining tool apparatus 20 being supported along the length of the structural beams 60, any canting of the derrick and mining tool is eliminated thereby substantially reducing the possibility of any bending of the mining tool 22 and drill section 24 assembly and the attendant twist-off situation heretofore associated by such a subsidence condition.

Once the particular mining operation has been completed within one of the mining zones such as 40B, the U-shaped mounting brackets 62 affixing the beams 60 to the foundation pair 50 may be removed and the entire beam 60 and platform 72 assembly may be transported as by way of crane (not shown) from the initial zone 40B and repositioned at an adjacent mining zone (such as 40A to 40C). Subsequently, the beams 60 may be affixed to the next respective foundation pair 50 (in the manner previously described) and an additional mining operation and mining cavity 30 may be formed. This process may continue for each of the mining zones 50A through 50F etc., until the entire mineral formation 10 is mined. Thus, by use of the apparatus and method of the present invention, the prior art's tendency of subsidence of the overburden during the mining of an unconsolidated mineral formation has been eliminated along with the attendant propensity of damage or loss of the mining tool during such a subsidence condition.

To augment the above described reduced overburden subsidence, and mining tool canting and bending benefits, the present invention additionally discloses a novel mining tool construction incorporating means for agitating the mined slurry within the mining cavity to maintain the mined minerals suspended within the mining slurry. With particular reference to FIGS. 7 through 14, the improved hydraulic mining tool apparatus of the present invention comprises a mining tool 100 which is connected at its uppermost end to a plurality of drill sections 102. The mining tool 100 and plural drill sections 102 are depicted in the actual mining process, being lowered into a pre-drilled borehold 104 which extends from ground surface 26 through the overburden 12 and into the unconsolidated mineral bed 14.

A jet pump supply conduit 122, jet pump eductor conduit 124, and cutting jet supply conduit 126 extend axially within the interior of the drill sections 103 initiating at a height above ground surface 26 and terminating within the mining tool 100. The uppermost end of the each of the conduits 122, 124, and 126 are provided with a conventional "Kelly" section (not shown) and a three passage swivel (not shown) which permits rotation of the mining tool 100, plural drill section 102 and conduits 122 through 126 while maintaining sealed connections of the conduits with respective surface pumping equipment 80 and 82 (seen in FIG. 3).

Figure 8:
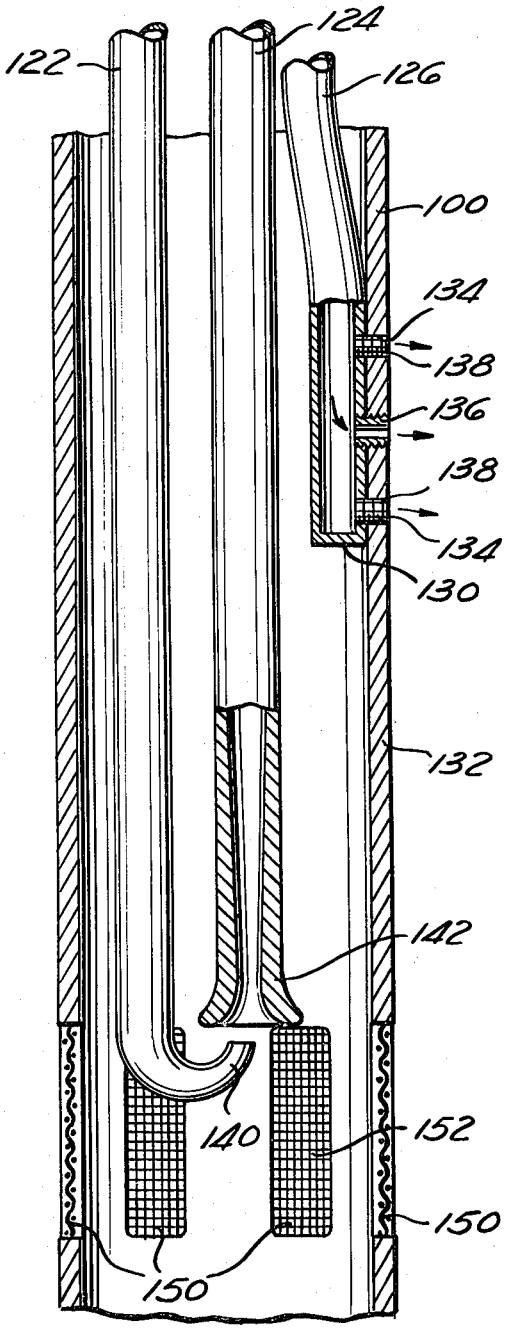
FIG. 8 is an enlarged cross-sectional view of the hydraulic mining tool of the present invention removed from the borehole of FIG. 7 and illustrating the internal construction thereof.

As best shown in FIG. 8, the cutting jet supply conduit 126 terminates at a manifold 130 disposed within the interior of the mining tool 100 and positioned adjacent its outer casing 132. The manifold includes a plurality of threaded apertures 134 which matingly receive either a nozzle insert 136 or a plug 138. By such an arrangement, high pressure fluid pumped through the cutting jet supply conduit 126 is directed radially outward through one or more of the nozzels 136 to contact the mineral bed 14 and dislodge minerals therefrom.

The jet pump supply conduit 122 additionally extends axially within the interior of the mining tool 100 terminating at a distance spaced vertically below the lowermost end of the eductor conduit 124. The distal end of the jet pump supply conduit 122 is provided with a nozzel 140 which is aligned with the axis of the eductor conduit 124. The eductor conduit 124 includes a venturi throat or transition section 142 whereby, as liquid is pumped through the cutting jet supply conduit 122 and directed upward through the eductor venturi 142, suction is created vertically below the venturi 142 which pulls the mined mineral slurry upward into the eductor conduit 124 for transported to ground surface 26. To permit the mined slurry to readily enter within the interior of the mining tool 100 and be acted upon by the suction developed by the venturi 142, a plurality of elongate apertures 150 extending through the casing 132 are provided. Each of the apertures or slurry inlets 150 preferably include a screen mesh 152 which prevents rock particles and the like from entering into the tool 100 which could dislodge within and obstruct the eductor conduit venturi throat 142.

Refering particularly to FIGS. 9 and 10, a plurality of elongate arm members or struts 160 are provided along the exterior surface of the casing 132 of the mining tool 100 and extend axially from a position vertically below the slurry inlets 150. The arm members 160 are pivotly mounted adjacent their uppermost end to the casing 132 and when disposed in their retracted position (as indicated in FIG. 9) are received within an elongate recess 162 formed in the casing 132. Plural hydraulic actuators 164 are attached at one end to the casing 132 and at the other end to the interior surface of each of the arm members 160 and are disposed in an aligned orientation with a respective access aperture 166 formed through the casing 132. Each of the hydraulic actuators 164 are preferably connected to a separate pressure line (not shown) which extends vertically within the interior of the mining tool 100 and drill sections 100 to ground surface such that each of the actuators may be independantly controlled from ground surface 26 during the mining operation.

In operation, the arm members 160 are initially maintained in their retracted position (as indicated in FIG. 9) to permit the mining tool 100 to be inserted downward into the mineral bed 14. Once the hydraulic mining process has been initiated and the mining cavity 30 formed, each of the hydraulic actuators 164 may be selectively actuated from ground surface 26 whereby the arm members 160 pivot radially outward to an extended position indicated in FIG. 10. As a hydraulic mining tool 100 rotates during the hydraulic mining process, the extended arm members 160 are pulled through the slurry thereby agitating or churning the slurry within the mining cavity 30 (as depicted in FIG. 7). This agitation enhances the suspension time of the mined mineral particles within the slurry and thereby insures that the slurry entering through the inlets 150 of the mining tool 100 carries a maximum quantity of mined material to the eductor venturi 142. Thus, by use of the arm members 160 of the present invention, a maximum amount of mined material is maintained in the slurry thereby maximizing the overall efficiency of the hydraulic mining process.

Due to each of the hydraulic actuators 164 preferably being independantly controlled from ground surface 26, the radial extension of each of the plural arm members 160 from the casing 132 may be varied during the mining operation. Advantageously, the radial extension of the arm members 160 may be varied in a progressive manner relative to the direction of rotation of the mining tool 100 (as depicted in FIG. 12) whereby during rotation of the mining tool, the slurry in addition to being agitated is progressively directed inward toward the inlets 150 of the tool by consecutive impingement upon the plural arm members 160. As such, a force feeding effect of the mined slurry into the interior of the mining tool 100 may be effectuated.

In FIG. 11, a similar force-feeding effect of the mined slurry toward the plural inlets 150 may be accomplished by utilizing varying length arm members 160. Preferably, the length of the plural arm members 160 increases progressively in the direction of the rotation of the mining tool such that during the mining operation, the slurry is continuously directed downward toward the slurry inlet 150. To augment the force feeding capabilities of arm members 160, the cross-sectional configuration of the arm members 160 may be formed with a concave innermost surface 170 (as depicted in FIG. 13) yielding a smaller leading edge 172 than trailing edge 174 for the arm members 160. During rotation of the mining tool 100 in the direction of the arrow indicated in FIG. 13, the mineral slurry slides across the concave surfaces 170 of the arm members 160 and is urged radially inward toward the slurry inlets 150.

As will be recognized, once the hydraulic mining process has been completed, the hydraulic actuators 164 may be actuated from ground surface 26 and returned to their initial orientation wherein each of the plural arm members 160 return to their retracted position as indicated in FIG. 9. Subsequently, the entire mining tool 100 may be removed from the mineral bed 14 without damage to the plural arm members 160.

In FIG. 14, an additional embodiment of the extensible arm members 160 of the present invention is depicted which further provides for a axial canting of the plural arm members 160 during operation. In this additional embodiment, the arm members are mounted to the casing 132 at their uppermost end by ball joint arrangement 180 which permits both pivotable as well as rotational movement. Although each of the arm members 160 could be provided with a separate hydraulic actuator (as in the embodiment of FIG. 10) in this additional embodiment, a single hydraulic actuator 182 is utilized within the interior of the casing 132 and includes plural linkages 184 extending from the actuator 182 to each of the plural arm members 160. A yoke 186 is provided at the interconnection between each of the linkages 184 and arm members 160 which permits rotation of the arm member relative to the linkages 184. Disposed in a generally parallel orientation and mounted to each of the linkages 184 is an additional hydraulic actuator 190 which is connected to a mounting lug rigidly affixed to one side of the arm members 160. By selectively actuating each of the hydraulic actuators 190 (as from ground surface 26), extension and retraction of the actuator 190 cause the arm members 160 to rotate or cant about their axis. Additionally, by selectively actuating the main hydraulic cylinder 182, upward movement of the linkages 184 cause the arm members 160 to extend radially outward between their retracted and opened position in the manner previously prescribed. Thus, by the additional embodiment of FIG. 14, during the hydraulic mining operation, the plural arm members 160 may be canted about their axis to provide either a minimum or maximum inpingement surface area during rotation of the mining tool 100. In those instances where maximum agitation of the slurry is desired, the arm members may be rotated such that their outermost surface is generally perpendicular to the rotational direction of the mining tool whereas when minimum agitation is required, the arm members 160 may be rotated such that their minimum surface area or edge is perpendicular to the rotational direction.

In FIG. 15, an additional embodiment of the plural arm members 160 of the present invention is depicted which provides for continuous rotation of the arm members 160 about their axis during the mining operation. As shown, the structure utilized in this embodiment is substantially identical to that previously described in relation to FIG. 14 except that the separate hydraulic actuators 190 (FIG. 14) are each replaced by a hydraulic motor 200 positioned at the uppermost end of the arm members 160. The hydraulic motors are pivotally mounted to the casing 132 at one end, and connected to a respective one of the arm members 160 at their other end by a suitable coupling 202. The linkages 184 extending from the main hydraulic actuator 182 include a bearing 204 which permits rotational movement of each of the arm members 160 relative to the linkages 184.

In operation, the plural arm members are extended radially outward from the casing 132 (in the manner previously described) to be disposed within the mineral formation. Once extended, each of the hydraulic motors 200 may be activated as by way of initiation of hydraulic fluid flow through suitable flow lines (not shown) extending from ground surface, whereby each of the arm members 160 rotate about their respective axis. By controlling the pressure and velocity of the fluid flow to the motors 200, the rotational speed may be varied during operation. As will be recognized, the rapid rotation of the arm members 160 about their axis in combination with the rotation of the mining tool 100 within the formation generates substantial turbulence within the mined mineral slurry which yields maximum suspension duration of the mined particles within the slurry. Thus, by use of the various embodiments of the arm members 160 of the present invention, the slurry is continuously agitated and maintained in suspension for maximum mineral recovery.

In addition to the remote support and slurry agitation features disclosed above, the present invention additionally provides a method of supplementing the amount of mineral material being mined to increase the mining-/recovery rate. The particular apparatus and process for effectuating this increased recovery is depicted in FIGS. 16 through 18 and comprises a plurality of cutting jet conduits 250 which are positioned radially outward from the mining tool 22 and submerged within the mineral formation 14 to direct a high velocity discharged stream toward the mining tool 22.

As best shown in FIG. 18, each of the plural conduits 250 are formed from an annular pipe length having an inside diameter of approximately 3 to 6 inches and a sealed lowermost end 252. Preferably, the end 252 includes a tapered configuration which permits the conduits 250 to be readily pile driven or inserted into the formation 14 from ground surface 26. One or more apertures 254 are provided through the wall of the conduits 250 and are vertically aligned with one another to extend a short distance upward along the length of the conduits 250. Each of the apertures 254 may include a threaded interior to matingly receive either a plug 256 or nozzle 258 adapted to prevent or accelerate fluid flow through the apertures 254 respectively.

Referring to FIGS. 16 and 17, the plural conduits 250 are submerged within the formation 14 at a distance radially spaced from the mining tool 22 and are preferably located in a symetric pattern thereabout. Typically, the radial distance of the conduits 250 from the mining tool 22 is approximately 25–50 feet, however, the actual distance may vary depending upon the make-up of the particular formation 14. The conduits are positioned to a depth generally corresponding to the depth of the mining tool 22 and are indexed relative thereto, such that the apertures 254 formed in the conduits 250 are directed toward the mining tool 22. Each of the conduits 250 are connected to a manifold piping arrangement 260 at their uppermost end which is coupled to a suitable high volume, high velocity pump 262, utilized to supply a cutting fluid stream to the interior of the conduits 250.

Upon the initiation of the hydraulic mining process (in the the manner previously described) fluid flow through the manifold piping arrangement 260 is commenced by actuation of the pump 262. The high pressure, high volume flow is transported through each of the plural conduits 250 and discharged outward through the plural apertures 254 adjacent the lowermost end of the conduits 250. As the fluid flow is discharged, the formation 14 is mined in an analgous manner to that occurring from the cutting jet of the hydraulic mining tool 22, whereby a resultant mineral slurry is formed. Due to the direction of the fluid discharge being radially toward the mining tool 22, as the mining process continues, the slurry is urged or transported toward the mining tool. As such, the amount of mined material available for recovery by the mining tool 22 is increased or supplemented by use of the plural conduits 250.

As will be recognized, the plural cutting jet conduits 250 may be utilized either alone or in conjunction with the elongate support beams 60 (FIG. 3) or agitation arm members 160 (FIGS. 9 through 14) of the present invention. When utilized with the support beams 60, it is preferable that the lengths of the support beams 60 is greater than the maximum radial spacing between the conduits 250 such that the mining tool is supported at a location radially beyond the position of the conduits 250.

In FIG. 19, an alternative method of remotely supporting the hydraulic mining tool apparatus 20 to isolate the mining tool 20 from damage caused by ground surface subsidence is illustrated. In this method, the mining tool derrick 28 is rigidly mounted to a pivoting support platform 300 which is affixed to the ground surface 26. By a suitable hydraulic actuator 302, the derrick 28 may be angularly inclined relative to ground surface 26 and maintained in the inclined position throughout the mining operation. Due to the mineral formation being located at a depth below the overburden 12, the mining cavity 30 formed by the mining tool 20, is laterally removed from beneath the derrick 28. As such, even if a ground surface subsidence is experienced during the mining process, (as indicated by the phantom line in FIG. 19) the derrick 28 and platform 300, being laterally spaced from the mining cavity 30, is isolated therefrom and maintained in a proper orientation.

Thus, in summary the present invention comprises a significantly improved hydraulic mining tool apparatus and method of hydraulically mining unconsolidated mineral formations which eliminates the subsidence and mining tool bending problems heretofore associated in the art and further provides effective means for agitating the slurry within the formation. Those skilled in the art will recognize that although in the preferred embodiment, specific materials and mechanisms have been described, obvious modifications to such materials and mechanisms may be readily made without departing the spirit of the present invention.

What is claimed is:

1. A method of hydraulically mining a subterranean mineral formation to prevent adverse bending of the mining tool apparatus during the mining operation comprising the steps of:

determining the anticipated maximum diameter of a mining cavity to be hydraulically formed within the subterranean mineral formation;

delineating the ground surface of said subterranean mineral formation into a plurality of mining zones each of said zones having a surface area greater than said anticipated maximum diameter of the mining cavity;

positioning a hydraulic mining tool apparatus within at least one of said mining zones at a location vertically aligned with the desired location of the mining cavity to be formed in the subterranean formation;

supporting the weight of said mining tool apparatus upon said ground surface at a lateral distance spaced from said vertically aligned location; and hydraulically mining said subterranean mineral formation beneath said vertically aligned location to form said mining cavity while isolating the compressive weight of said mining tool apparatus from said vertically aligned location.

2. The method of claim 1 wherein said hydraulic mining step comprises the steps of:

forming a bore hold extending from ground surface at an angular inclination into said subterranean mineral formation;

and inserting the mining tool of said mining tool apparatus into said bore hole to be exposed within said mineral formation beneath said vertically aligned location.

3. The method of claim 1 wherein said supporting step comprises the steps of:

positioning a pair of foundations on said ground surface, said foundations spaced from one another at a distance greater than said anticipated maximum diameter of the mining cavity;

placing a pair of elongate beams to extend between said pair of foundations; and mounting said hydraulic mining tool apparatus upon said elongate beams and between opposite ends of said beams so as to be positioned at said vertically aligned location.

4. The method of claim 3 wherein said mounting step comprises releasably affixing said mining tool apparatus to said pair of elongate beams.

5. The method of claim 4 further comprising repeating said position, placing, mounting and mining steps in each of said mining zones of said subterranean mineral formation.

* * * * *